US007517412B2

(12) United States Patent
Atwell

(10) Patent No.: US 7,517,412 B2
(45) Date of Patent: Apr. 14, 2009

(54) ASH AND DUST REMOVAL METHOD

(75) Inventor: Charles Gary Atwell, Mechanicsville, VA (US)

(73) Assignee: Philip Morris USA Inc., Richmond, VA (US)

( * ) Notice: Subject to any disclaimer, the term of this patent is extended or adjusted under 35 U.S.C. 154(b) by 142 days.

(21) Appl. No.: 11/605,081

(22) Filed: Nov. 28, 2006

(65) Prior Publication Data

US 2007/0068556 A1 Mar. 29, 2007

Related U.S. Application Data

(62) Division of application No. 10/607,795, filed on Jun. 27, 2003, now Pat. No. 7,146,678.

(51) Int. Cl.
*B08B 5/04* (2006.01)

(52) U.S. Cl. ..... 134/15; 134/21; 15/300.1; 15/306.1; 15/309.1

(58) Field of Classification Search ..... 134/15, 134/21, 42; 15/309.1, 306.1, 300.1; 493/327, 493/342, 373; 162/199, 172
See application file for complete search history.

(56) References Cited

U.S. PATENT DOCUMENTS

| | | | | |
|---|---|---|---|---|
| 3,266,196 | A | | 8/1966 | Barcaro |
| 3,475,782 | A | * | 11/1969 | Teuber ..... 15/308 |
| 4,010,514 | A | * | 3/1977 | Fischer et al. ..... 15/309.1 |
| 4,370,942 | A | | 2/1983 | Dowding et al. |
| 4,608,037 | A | | 8/1986 | Fleming, III |

* cited by examiner

*Primary Examiner*—Michael Barr
*Assistant Examiner*—Saeed T Chaudhry
(74) *Attorney, Agent, or Firm*—Connolly Bove Lodge & Hutz LLP

(57) ABSTRACT

A method of removing dust, dirt and the like from the surface of a paper substrate comprises the steps of transporting the paper substrate along a path of travel, and training the paper substrate over and in direct contact with at least a portion of the outer surface of a vacuum drum having openings therein. Suction is applied to the openings as the paper moves over the drum at a slightly different linear velocity from the surface velocity of the drum. Dust, dirt and the like are drawn away from one surface of the paper substrate through the openings of the drum as the paper substrate sweeps over the vacuum drum surface.

4 Claims, 2 Drawing Sheets

ASH AND DUST REMOVAL METHOD

CROSS-REFERENCE TO RELATED APPLICATION

The present application is a division of application Ser. No. 10/607,795, filed Jun. 27, 2003.

BACKGROUND OF THE INVENTION

The present invention relates to a system for removing dirt, dust and the like from a flexible substrate, and more particularly to a system for the removal of ash and dust from perforated tipping paper used to wrap filter and tobacco components in the manufacture of cigarettes.

Over the years optical technology has been developed for the inspection of tipping paper used in the manufacture of cigarettes. Tipping paper may be cork-like or opaque white in appearance and is wrapped around a cigarette filter to join the filter to the end of a tobacco rod. Tipping paper is often perforated to impart a desired permeability to the paper to introduce air into tobacco smoke during the smoking process. Optical technology is often used to inspect the permeability of the paper during the perforation process before the paper is actually used in cigarette production. However, the optical devices used in this technology are quite sensitive to dust and dirt build-up as well as the ash remaining particularly when lasers are used to form the newly created holes. Overall, the perforation process generates significant quantities of dust and/or ash in addition to the dust and dirt already present on the tipping paper. Also, proper optical inspection requires that the paper path be stable and not oscillate from side-to-side.

Typical methods for cleaning the paper includes brushes, fixed guides or edges, air jets and/or general vacuum from fixed devices. These procedures provide some relief to dust build-up, but they do not effectively clean out the perforated holes which is necessary to ensure reliability of optical sensors to see through the perforations.

Another problem is that as the tipping paper moves along its path of travel the paper path is not stable. The paper tends to oscillate side-to-side which causes problems with alignment, sensing and rewind quality.

SUMMARY OF THE INVENTION

Accordingly, one of the objects of the present invention is a procedure for effectively and efficiently removing dirt, ash, dust and the like from a perforated paper substrate particularly from the perforations of the paper so that the permeability of the paper can be accurately determined.

Another object of the present invention is a system for effectively and efficiently removing extraneous material from perforated paper substrates whereby optical sensing of the permeability of the paper may be accurately determined.

Still another object of the present invention is to efficiently and effectively maintain the stability of the perforated paper substrate as it moves along its path of travel and thereby eliminate or substantially reduce side-to-side oscillations.

In accordance with the present invention, a system for removing dust, dirt and the like from the surface of a flexible paper substrate comprises a transport assembly for conveying the paper substrate along a path of travel. The transport assembly includes a rotating vacuum drum having an outer surface over which the paper substrate is trained in the direction of drum rotation as it moves along the path of travel. The surface speed of the rotating drum is slightly different from the linear speed of the paper substrate and this differential causes the substrate to sweep across the drum surface. Openings are provided in the outer surface of the vacuum drum, and a suction source is connected to the openings so that dust, dirt and the like on the surface of the paper substrate are drawn away by the suction as the paper substrate sweepingly moves along over the surface of the drum. The openings in the outer surface of the vacuum drum are arranged on the outer periphery of the drum and may comprise a plurality of circular openings. Alternatively the openings may comprise slotted openings having an orientation substantially parallel to an axis of rotation of the drum.

In one embodiment, each slotted opening extends from one side of the drum to the other side. In another embodiment pairs of spaced apart slotted openings extend from one side to the other.

An adjustment device may be connected to shift the vacuum drum transversely relative to the path of travel of the paper substrate to thereby adjust the position of the outer surface of the drum and the openings therein relative to the paper substrate.

The system of the present invention is particularly adapted to remove dust, dirt and the like from a paper substrate that includes perforations. Laser technology often used to form perforations in the paper leaves a residue within the newly formed holes and that residue is efficiently and effectively removed by the system of the present invention.

The transport assembly may include a second rotating vacuum drum having an outer surface over which the paper substrate is trained in the direction of rotation of the second drum as the paper moves along the path of travel. Openings are provided in the outer surface of the second drum and a suction source is connected to those openings to withdraw dust, dirt and the like from the paper substrate. The vacuum drums of this transport assembly rotate in opposite directions so that dust, dirt and like on one side of the paper substrate are drawn away by suction while dust, dirt and like on the other side of the paper substrate are drawn away by suction applied to the second drum as the paper substrate moves along the path of travel.

Additionally and in accordance with the present invention, a method of removing dust, dirt and like from the surface of a paper substrate comprises the steps of transporting the paper substrate along a path of travel, training the paper substrate over at least a portion of the outer surface of a vacuum drum having openings therein, applying suction to the openings in the outer surface of the vacuum drum and drawing away dust, dirt and the like from the surface of the paper substrate through the openings in the vacuum drum as the paper substrate moves along the path of travel.

The vacuum applied to the paper substrate also holds the substrate in engagement with the surface of the vacuum drum. This interaction functions to prevent the paper substrate from side-to-side oscillations as it moves along its path of travel, and as such, inspection, slitting of the substrate and rewinding are efficiently accomplished.

Preferably, the vacuum drum includes a section where the paper substrate does not engage the drum surface. The vacuum openings are purged with air under pressure in this drum section to thereby remove extraneous material removed from the substrate by the applied vacuum.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
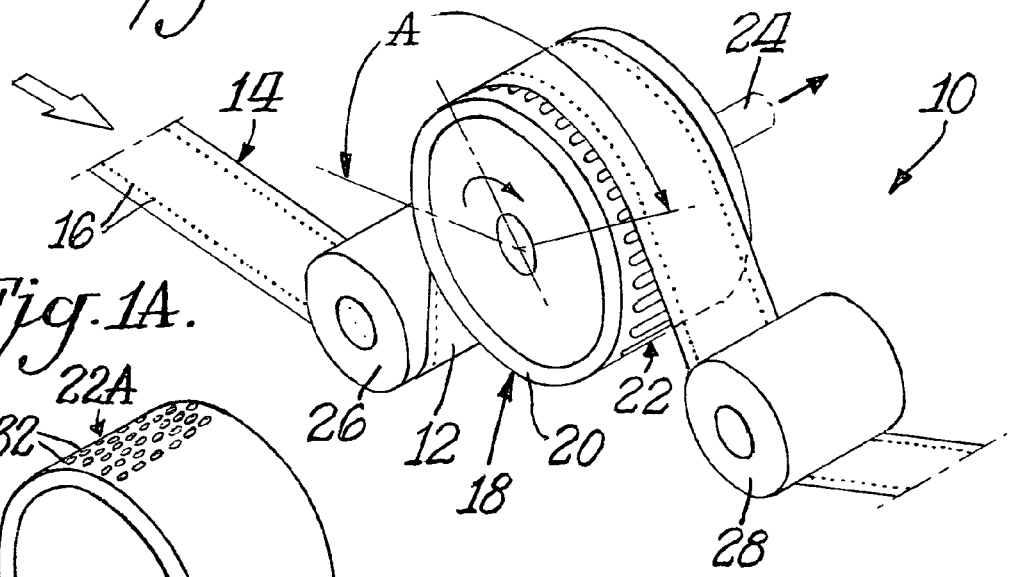
FIG. 1 is a perspective view of a system for removing dirt, dust, ash and the like from a perforated paper substrate, according to the present invention.

Referring in more particularity to the drawings, FIG. 1 illustrates a system 10 for removing dust, dirt and like from the surface 12 of a flexible paper substrate 14. The paper substrate may comprise tipping paper used in the manufacture of cigarettes. Such tipping paper may be cork-like colored, printed, opaque white, etc. in appearance and is traditionally wrapped around a cigarette filter to join the filter to the end of a tobacco rod.

Tipping paper is often perforated along the edge portions thereof and such perforations 16 are shown in FIG. 1. These perforations impart a desired permeability to the paper to introduce air into tobacco smoke during the smoking process. Optical technology is often used to inspect the permeability of the paper during the perforation process before the paper is actually used in cigarette production. The optical devices used in this technology are quite sensitive to dust and dirt build-up as well as the ash remaining in the newly created holes 16 particularly when lasers are used to form the holes. The system 10 of the present invention removes any extraneous material from the tipping paper so that optical inspection of the permeability of the paper is accurately determined.

System 10 comprises a transport assembly 18 for conveying the paper substrate 14 along a path of travel. The transport assembly primarily includes a rotating vacuum drum 20 having an outer surface over which the paper substrate 14 is trained in the direction of drum rotation as it moves along the path of travel. Openings 22 are provided in the outer surface of the vacuum drum 20, and a suction source 24 is connected to the openings 22 on the outer surface of the vacuum drum 20 to thereby withdraw dust, dirt and like from the surface of the paper substrate as it moves along the path of travel over the vacuum drum 20. Idler rollers 26, 28 may be positioned upstream and downstream of the vacuum drum 20, as shown in FIG. 1.

The paper substrate is pulled along its path of travel, and its linear velocity is slightly different from the surface velocity of the vacuum drum. The substrate may be pulled by a wind-up roller such as described below in conjunction with FIG. 3. Alternatively, roller nips that include at least one driven roller may be positioned to draw the paper substrate along its path of travel. The differential between the linear speed of the paper substrate and the surface speed of the vacuum drum causes the paper to sweep across the drum surface thereby positioning all of the perforations over the vacuum openings for efficient removal of any material within the perforations. The linear speed of the paper substrate may be slightly greater or slightly less than the surface velocity of the vacuum drum. This allows the perforations initially between the openings 22 to sweep forward or backward over the adjacent openings before leaving the drum surface. When the linear speed of the paper substrate is slightly greater than the surface velocity of the drum the perforations move forward relative to the drum surface. The converse occurs when the linear speed of the paper substrate is slightly less than the surface speed of the drum.

In the embodiment of FIG. 1, the openings 22 in the outer surface of the vacuum drum 20 comprise a plurality of slotted openings 30 each having an orientation substantially parallel to each other, but not necessarily to the axis of rotation of the drum. The slotted openings generally extend from one side of the vacuum drum to the other. Hence, suction from the source 24 is delivered to the slotted openings 30 so that the paper substrate 14 in engagement with the vacuum drum 20 is subjected to such suction to thereby remove dust, dirt and like from the surface thereof.

Figure 1A:
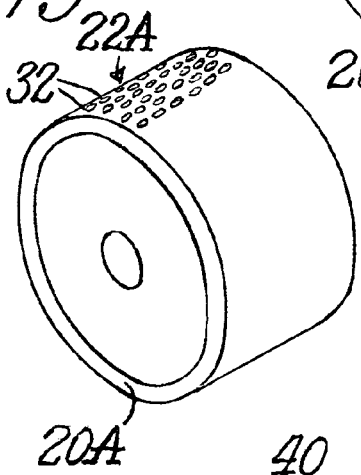
FIG. 1A is a perspective view of an alternative vacuum drum for the system shown in FIG. 1.

FIG. 1A illustrates an alternative vacuum drum 20A having openings 22A in the outer surface of the drum and arranged on an outer periphery of the drum. However, these openings 22A comprise a plurality of circular openings 32. Suction from a source such as 24 is delivered to these circular openings. The smaller circular openings enable the surrounding drum surface to impart increased support for the paper substrate when compared to the slotted openings 30. The circular openings are preferred when additional support is needed for paper substrates having increased width and possibly decreased thicknesses. Otherwise, drum 20A functions in the same manner as drum 20.

Figure 1C:
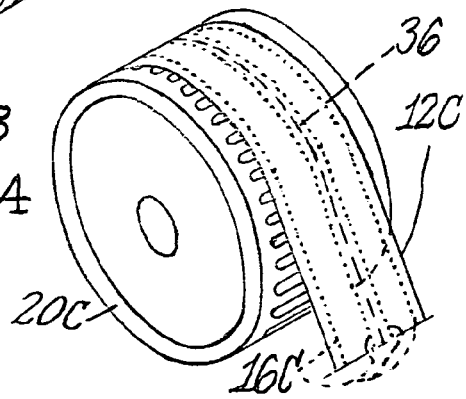
FIG. 1C is a perspective view of another vacuum drum for the system shown in FIG. 1, according to the present invention.
Figure 1B:
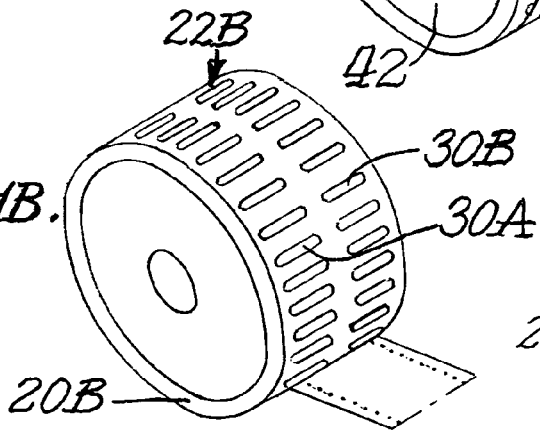
FIG. 1B is a perspective view of still another vacuum drum for the system shown in FIG. 1, according to the present invention.

FIG. 1B illustrates still another vacuum drum 20B having openings 22B in the outer surface of the drum arranged on an outer periphery thereof. However, these openings comprise a plurality of slotted openings where pairs of spaced apart slotted openings 30A, 30B extend from one side of the drum to the other. This arrangement also provides additional support for the paper substrate when compared to the singular slotted openings 30 of vacuum drum 20.

FIG. 1C shows another vacuum drum 20C having openings 22C in the outer surface of the drum arranged on the outer periphery thereof. Drum 20C is sufficiently wide to accommodate a double wide paper substrate 12C with four rows of perforations 16C. The substrate is subsequently slit along line 36. Alternatively, the paper substrate 12C may be even wider for multiple slitting such as 2, 3, 4 or 5 slits so that one substrate is slit into 3, 4, 5 or 6 pieces, for example.

Figure 2:
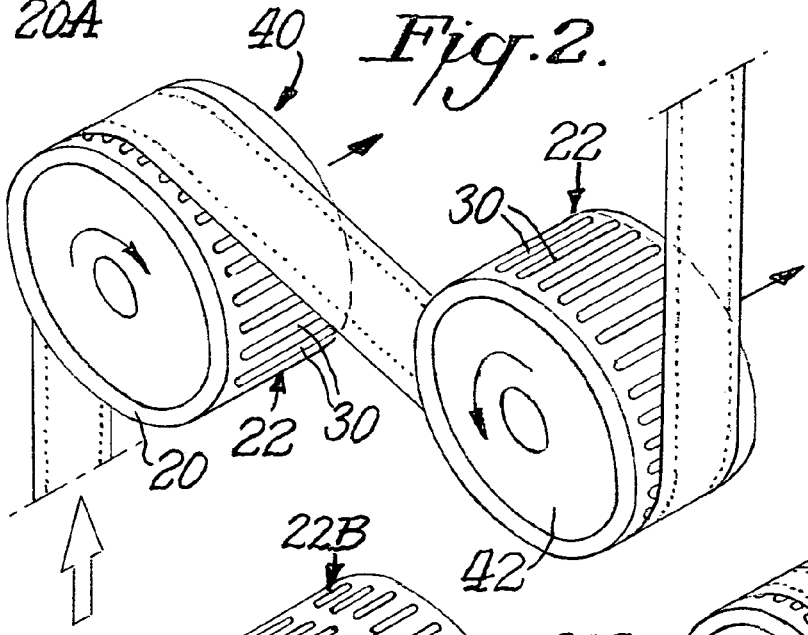
FIG. 2 is a perspective view of another system for removing dust, dirt, ash and the like from both sides of a perforated paper substrate, according to the present invention.

FIG. 2 illustrates an alternative system 40 for removing dust, dirt and like from both surfaces of the flexible paper substrate 14. In this embodiment, vacuum drum 20 is used in combination with a second vacuum drum 42 similar in all respects to drum 20, but rotating in an opposite direction. The paper substrate 14 is trained around each of the drums 20, 42 in the direction of rotation of these drums, as shown in FIG. 2. Hence, after one side of the paper substrate 14 is cleaned of dust, dirt and like by vacuum drum 20, the other surface of the paper substrate is cleaned by the second vacuum drum 42. The differential between the linear speed of the paper substrate and the surface velocity of the drums 20, 42 causes the substrate to sweep across the surface of the drums.

Figure 3:
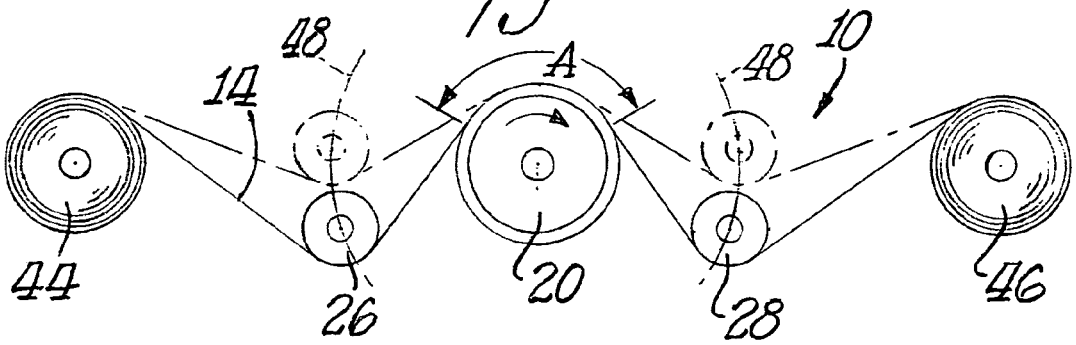
FIG. 3 is a diagrammatic side elevational view of the system shown in FIG. 1 including a supply roll of perforated paper and a driven take-up roller for pulling the paper through the system, according to the present invention.

FIG. 3 is a side elevational view of the system shown in FIG. 1. A supply roll 44 of paper substrate is positioned at the entrance of the system 10, and a driven take-up roll 46 is utilized to receive and store the paper substrate after the dust, dirt and the like is removed from the surface thereof. A similar arrangement may be used with the system 40 of FIG. 2.

FIG. 3 also illustrates another important aspect of the present invention where the idler rollers 26, 28 are adjustable each along an arc 48 having a radius from the axis of rotation of drum 20 to the axis of rotation of the idler rollers. Positioning the idler rollers along these arcs adjusts the extent A of paper engagement with the surface of the vacuum drum 20. The relative velocity between the paper and drum together with the distance the paper is in contact with the drum determine the extent of vacuum cleaning.

Figure 4:
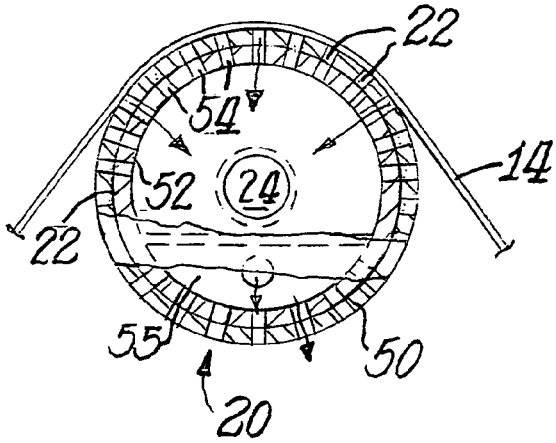
FIG. 4 is an end elevational view of a vacuum drum with portions thereof broken away to illustrate interior details particularly the supply of suction to an outer surface portion of the drum in engagement with the flexible substrate as well as an air purge for cleaning the suction openings, according to the present invention.

FIG. 4 shows interior details of the vacuum drums 20, 20A, 20B and 42 for supplying suction to the openings 22 on the outer periphery of the drum. In this particular embodiment the drum includes a rotatable annular outer section 50 that includes the openings 22 over the entire periphery of the drum. The drum further includes an inner section 52 which is stationary and this stationary section of the drum includes openings 54, but only over the portion of the drum in contact with the paper substrate. Suction from source 24 is continuously supplied to the openings 54 on the inner section 52 of the drum and when these openings 54 register with the openings 22 in the outer section 50, such suction is applied to the paper substrate 14.

Drum 20 also includes a section 55 where the openings 54 are supplied with air under pressure to purge the openings 22 of any extraneous material when they register with the openings 54. Such purging occurs when the openings 22 are out of contact with the paper substrate.

Figure 5:
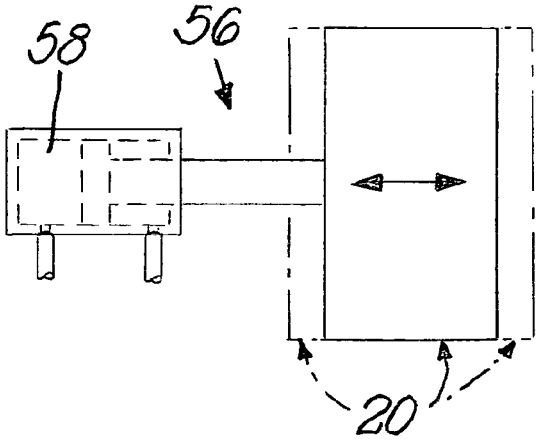
FIG. 5 is a diagrammatic view illustrating transverse adjustment of a vacuum drum in relation to the path of travel of the paper substrate over the drum, according to the present invention.

FIG. 5 shows a simple arrangement 56 whereby the vacuum drum 20, 20A, 20B and 42 may be adjusted relative to the path of travel of the paper substrate 14. The arrangement may include a hydraulic piston and cylinder device 58 for transversely shifting the vacuum drum to adjust its position relative to the path of travel of the paper substrate.

Figure 6:
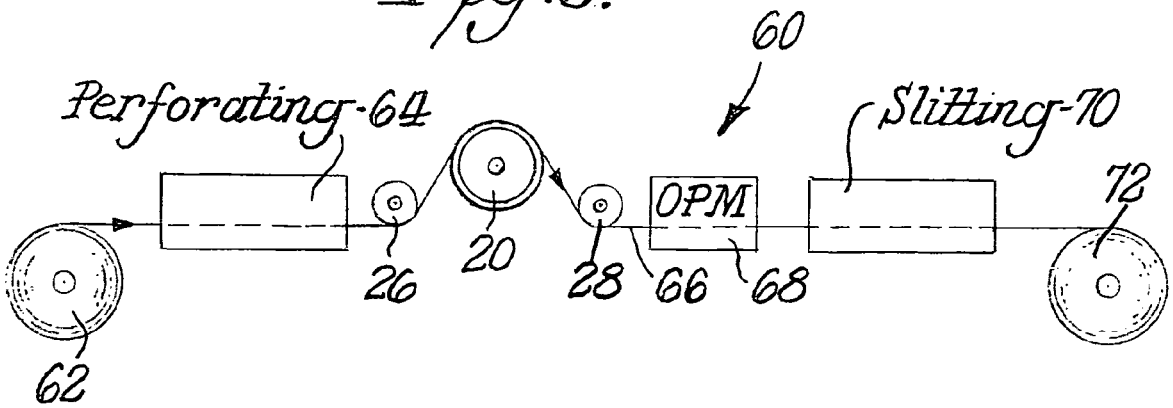
FIG. 6 is a diagrammatic side elevational view of a system that includes a supply roll of paper, a perforation station, a cleaning station, an optical permeability monitor, a paper slitting station and a take-up roller or rollers for the perforated paper, according to the present invention.

FIG. 6 shows an overall arrangement 60 including a roll of unperforated paper 62 for delivery to a perforating station 64 where the paper is perforated, as explained above. After cleaning at vacuum drum 20 the perforated paper 66 is inspected by an optical permeability monitor (OPM) 68. The paper may then be separated at a slitting station 70 and wound on bobbins 72.

It should be understood that the above detailed description while indicating preferred embodiments of the invention are given by way of illustration only since various changes and modifications within the spirit and scope of the invention will become apparent to those skilled in the art from the detailed description. Moreover, it should be noted that the vacuum applied to clean the perforations also functions to maintain a true path for the paper substrate by preventing side-to-side oscillations. In this regard, the overall system may be utilized as a positioning device without cleaning, and under those circumstances the linear speed of the substrate may be the same as the surface velocity of the vacuum drum or drums.

What is claimed is:

1. A method of removing dust and dirt from the surface of a paper substrate comprising the steps of:

transporting the paper substrate along a path of travel;

training the paper substrate over and in direct contact with at least a portion of the outer surface of a vacuum drum having openings therein;

applying suction to the openings in the outer surface of the vacuum drum;

moving the paper substrate at a different linear velocity from the surface velocity of the vacuum drum; and drawing away dust and dirt from one surface of the paper substrate through the openings as the paper substrate sweeps over the vacuum drum surface.

2. A method as in claim 1 including the further steps of:

training the paper substrate over at least a portion of the outer surface of a second vacuum drum having openings therein;

rotating the second vacuum drum in a direction opposite to the rotation of the other vacuum drum;

applying suction to the openings in the outer surface of the second vacuum drum; and drawing away dust and dirt from the other surface of the paper substrate as the paper substrate moves along the path of travel.

3. A method as in claim 1 including the step of transversely shifting the vacuum drum to thereby adjust the position of the outer surface of the drum relative to the paper substrate.

4. A method as in claim 1 wherein the paper substrate includes perforations and dust and dirt within the perforations are removed by the applied suction.

* * * * *